US007988499B2

(12) United States Patent
Lin et al.

(10) Patent No.: US 7,988,499 B2
(45) Date of Patent: Aug. 2, 2011

(54) RECEPTACLE CONNECTOR HAVING SHUTTLE TO SELECTIVELY SWITCH TO DIFFERENT INTERFACES

(75) Inventors: Chih-Nan Lin, Tu-Cheng (TW); Wei-Chung Lin, Tu-Cheng (TW); Jui-Kuang Chung, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 32 days.

(21) Appl. No.: 12/630,725

(22) Filed: Dec. 3, 2009

(65) Prior Publication Data

US 2010/0136848 A1 Jun. 3, 2010

(30) Foreign Application Priority Data

Dec. 3, 2008 (TW) ..... 97221617 U

(51) Int. Cl.
*H01R 13/514* (2006.01)

(52) U.S. Cl. ..... 439/701

(58) Field of Classification Search ..... 439/660, 439/701, 222, 527, 682, 625, 638, 639, 607.01, 439/607.22, 607.34
See application file for complete search history.

(56) References Cited

U.S. PATENT DOCUMENTS 7,371,116 B2 5/2008 Chiang
7,517,253 B1 * 4/2009 Chiang ..... 439/660
7,833,065 B2 * 11/2010 Lin et al. ..... 439/639
2007/0173121 A1 * 7/2007 Chiang
2007/0218762 A1 * 9/2007 Liao et al.
2009/0111330 A1 * 4/2009 Lin et al.
2009/0181578 A1 * 7/2009 Chen et al.
2009/0298352 A1 * 12/2009 Murakami
2010/0003849 A1 * 1/2010 Murakami ..... 439/527
2010/0087093 A1 * 4/2010 Yu et al. ..... 439/607.01
2010/0136848 A1 * 6/2010 Lin et al.
2010/0159748 A1 * 6/2010 Chang
2010/0173530 A1 * 7/2010 Tsai
2010/0203751 A1 * 8/2010 Tsai
2010/0216327 A1 * 8/2010 Lin et al.
2010/0216340 A1 * 8/2010 Lin et al.
2010/0248545 A1 * 9/2010 Lin et al.
2010/0255702 A1 * 10/2010 Lin et al.

FOREIGN PATENT DOCUMENTS

TW M335829 7/2008

* cited by examiner

*Primary Examiner* — Alexander Gilman
(74) *Attorney, Agent, or Firm* — Andrew C. Cheng; Wei Te Chung; Ming Chieh Chang

(57) ABSTRACT

A receptacle connector including at least three mating interfaces is provided and includes an insulative housing with a first and second groups of contacts mounted thereon. The first group of contacts serve as first Interface (USB 2.0), and a second group of contacts alternatively serve as mating interface of second and third interfaces (ESATA and USB 3.0). A switching board is provided and includes mounting interface of the second and the third interfaces. A shuttle member is moveably disposed within the housing and selectively interconnects the second group of contacts with either the mounting interface of the second interface or mounting interface of the third interface.

18 Claims, 18 Drawing Sheets

RECEPTACLE CONNECTOR HAVING SHUTTLE TO SELECTIVELY SWITCH TO DIFFERENT INTERFACES

BACKGROUND OF THE INVENTION

1. Field of the Invention

The present invention relates to a receptacle connector, and more particularly to a receptacle connector incorporated with a switch to selectively interconnect different interfaces.

2. Description of Related Art

U.S. Pat. No. 7,371,116 issued to Chiang on May 13, 2008 discloses a connector socket for external serial ATA (generally referred to as eSATA) and universal serial bus (USB) plugs has a casing, an eSATA contact set and a USB contact set. The casing has a cavity defined in the casing, an inner rear surface and a contact seat formed on and extending forward from the inner rear surface. The eSATA contact set is mounted on the contact seat and has multiple eSATA contacts being conductive and mounted on the contact seat. The USB contact set is mounted on the contact seat opposite to the eSATA contact set and has multiple USB contacts being conductive and mounted on the contact seat. The connector socket having the single contact seat is compact.

Taiwanese Pat No. M335829 issued to the same assignee of U.S. Pat. No. 7,371,116 discloses an improved connector socket which can be referred to as a combo connector in which plug connector made according to USB 2.0, USB 3.0, and eSATA can be readily inserted. The connector socket generally includes a cavity with a contact seat disposed therein. Four first contacts which are compliant for USB 2.0 protocol are set on the upper surface of a contact seat. Seven second contacts which are compliant for eSATA protocol are set on the lower surface of the contact seat. Five of said seven second contacts extend further to define contact portions arranged at the upper surface of a contact seat. The contact portions together with the four first contacts form a port compliant for the USB 3.0 protocol. It can be readily seen from the disclosure that the lower surface of the contact seat serves as a common platform for both the USB 3.0 and eSATA interface and this may create some interference when different signals run through those common platform. Obviously, an improved electrical connector is highly desired to overcome the aforementioned problem.

SUMMARY OF THE INVENTION

An object of the present invention is to provide an electrical connector which can avoid the signal interference.

In order to achieve above-mentioned object, a receptacle connector including at least three mating interfaces is provided and includes an insulative housing with a first and second groups of contacts mounted thereon. The first group of contacts serve as first Interface (USB 2.0), and a second group of contacts alternatively serve as mating interface of second and third interfaces (ESATA and USB 3.0). A switching board is provided and includes mounting interface of the second and the third interfaces. A shuttle member is moveably disposed within the housing and selectively interconnects the second group of contacts with either the mounting interface of the second interface or mounting interface of the third interface.

Other objects, advantages and novel features of the present invention will become more apparent from the following detailed description of the present embodiment when taken in conjunction with the accompanying drawings.

DETAILED DESCRIPTION OF THE INVENTION

Figure 1:
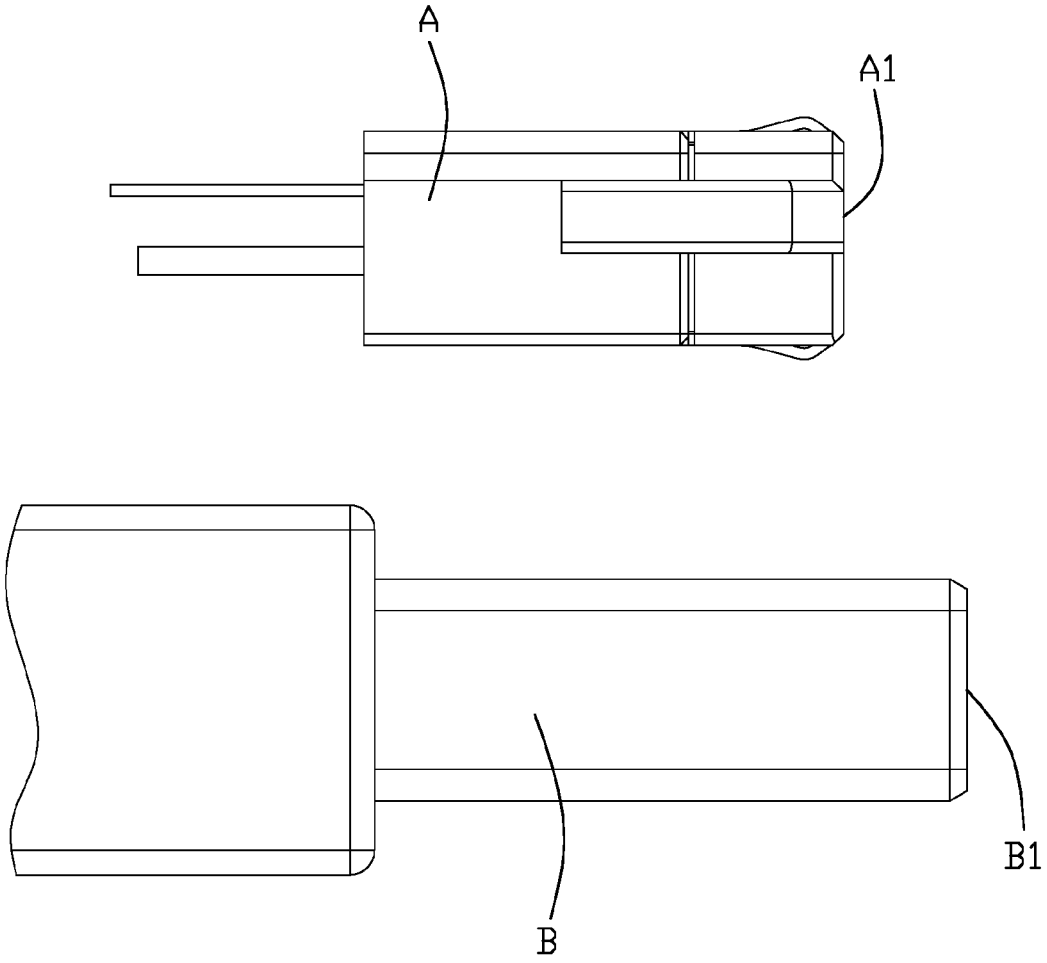
FIG. 1 is a side view of two electrical plugs adapted for inserting into an electrical connector in accordance with the present invention.
Figure 2:
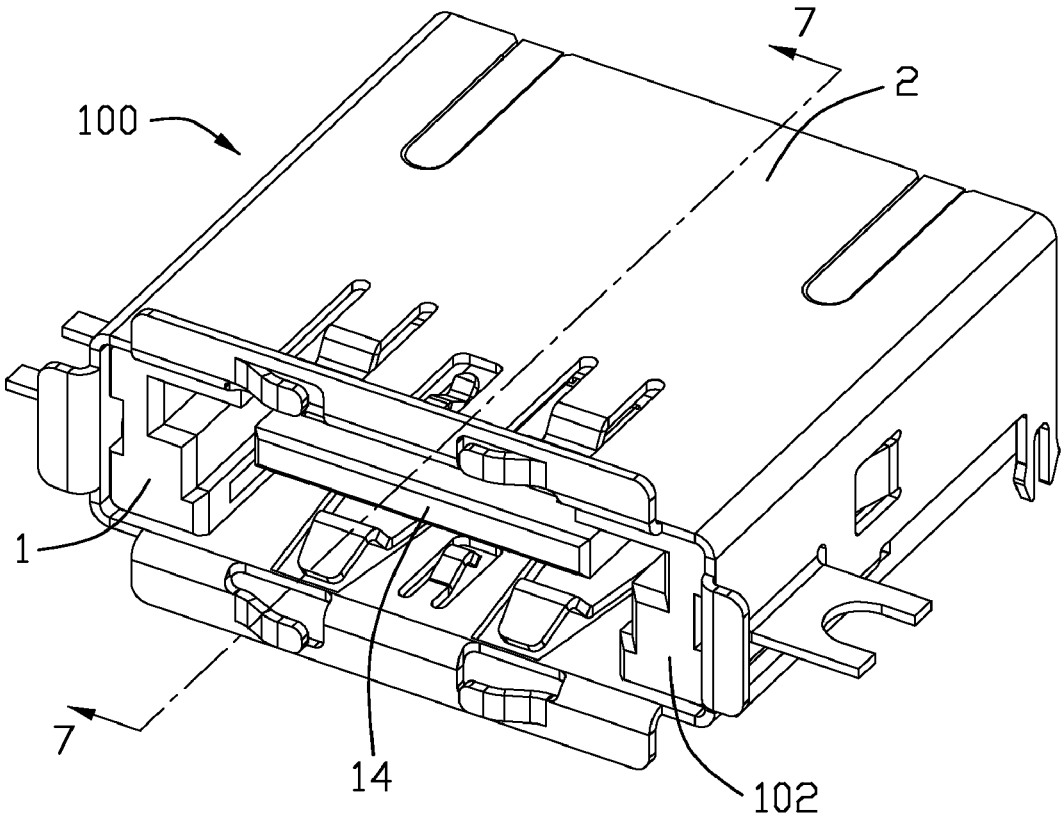
FIG. 2 is a perspective view of a first embodiment of the electrical connector.

Reference will now be made to the drawing figures to describe four preferred embodiments of the present invention in detail.

Referring to FIG. 1, two plugs are shown, plug A is an eSATA plug connector, and plug B is a USB 3.0 plug connector. The mating port A1 of the eSATA plug A is shorter than the mating port B1 of the USB 3.0 plug B in a mating direction, and said two ports can be alternatively inserted into a mating cavity of an electrical connector 100 of the present invention and which will be described later.

FIG. 2 to FIG. 18 show a variety of embodiments of the present invention. The same elements are designated by same reference numeral and terminology through those embodiments. The electrical connector 100 comprises an insulating housing 1, a shielding shell 2, sets terminal 3 and a shuttle device for switching from different set of terminals so as to establish eSATA interface and USB 3.0 interface.

Figure 3:
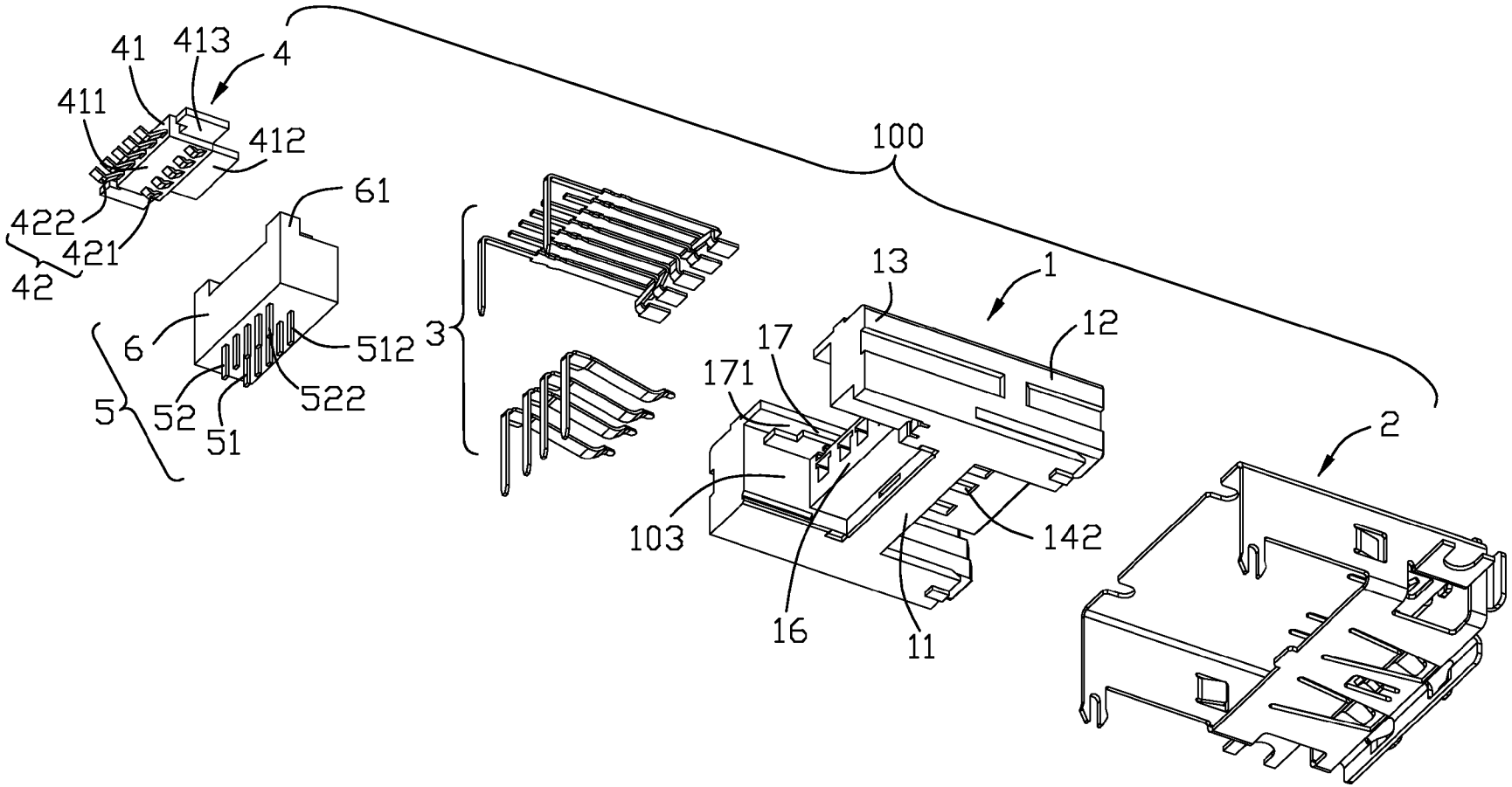
FIG. 3 is an exploded perspective view of the electrical connector shown in FIG. 2.
Figure 4:
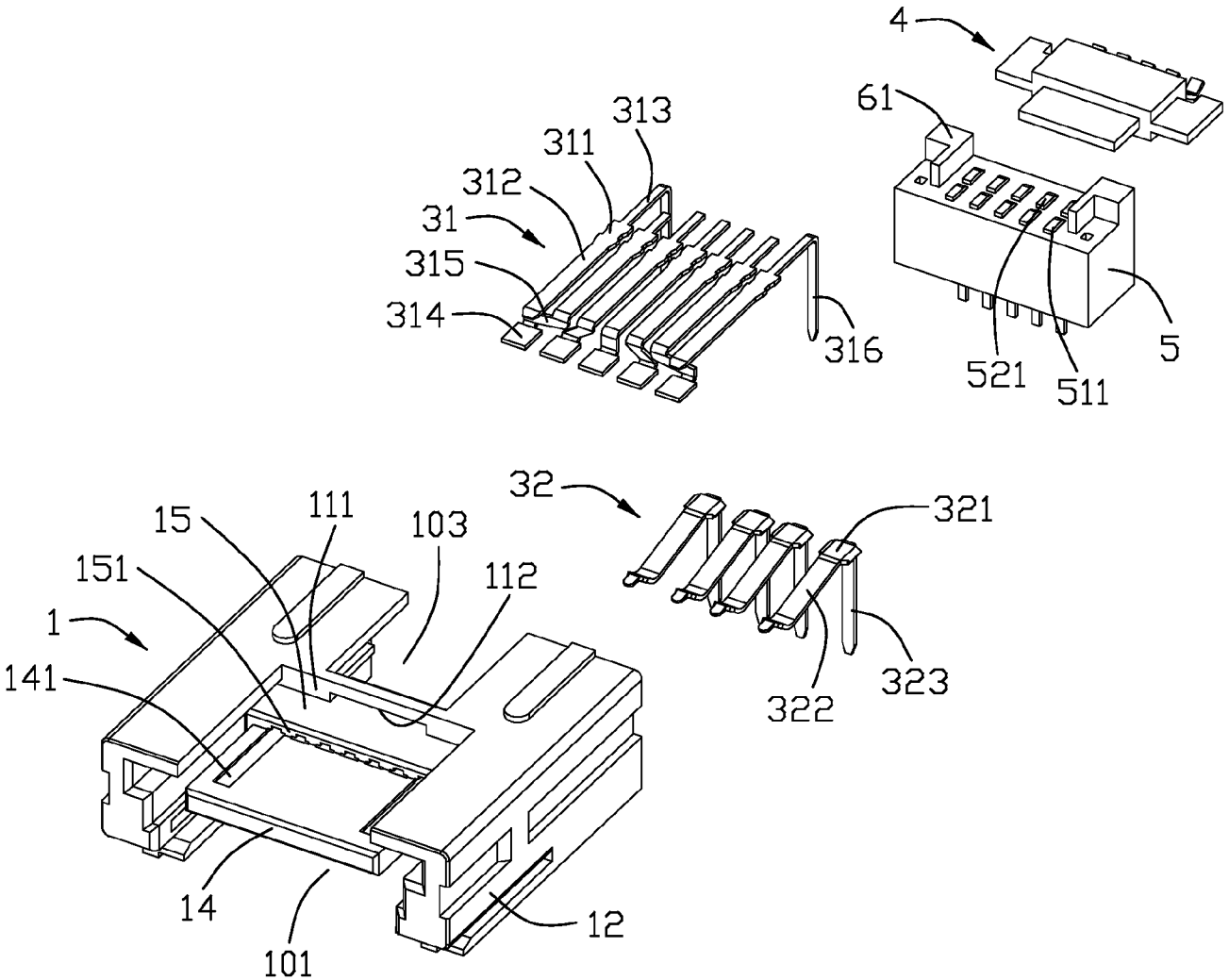
FIG. 4 is another exploded perspective view of the electrical connector shown in FIG. 2 without showing a metallic shell.

FIGS. 1~9 show the first embodiment. Referring to FIG. 3 and FIG. 4, the insulating housing 1 includes a base portion 11, a pair of front sidewalls 12 and a pair of rear sidewalls 13 respectively extending from two opposite ends of the base portion. A receiving cavity 103 is defined by the pair of rear sidewalls 13 and the base portion 11 commonly and a mating cavity 101 is defined by the pair of front sidewalls 12 and the base portion 11 commonly. The mating cavity 101 runs through a front end 102 of the housing. A tongue portion 14 projects forwards from a front face of the base portion 11 into the mating cavity 101, which defines a plurality of passageways 141, 142 on an upper and a lower faces thereof for receiving the terminals 3 thereon. A stand-off portion 15 is formed at a joint of the upper face of the tongue portion 14 and the base portion 11.

Figure 7:
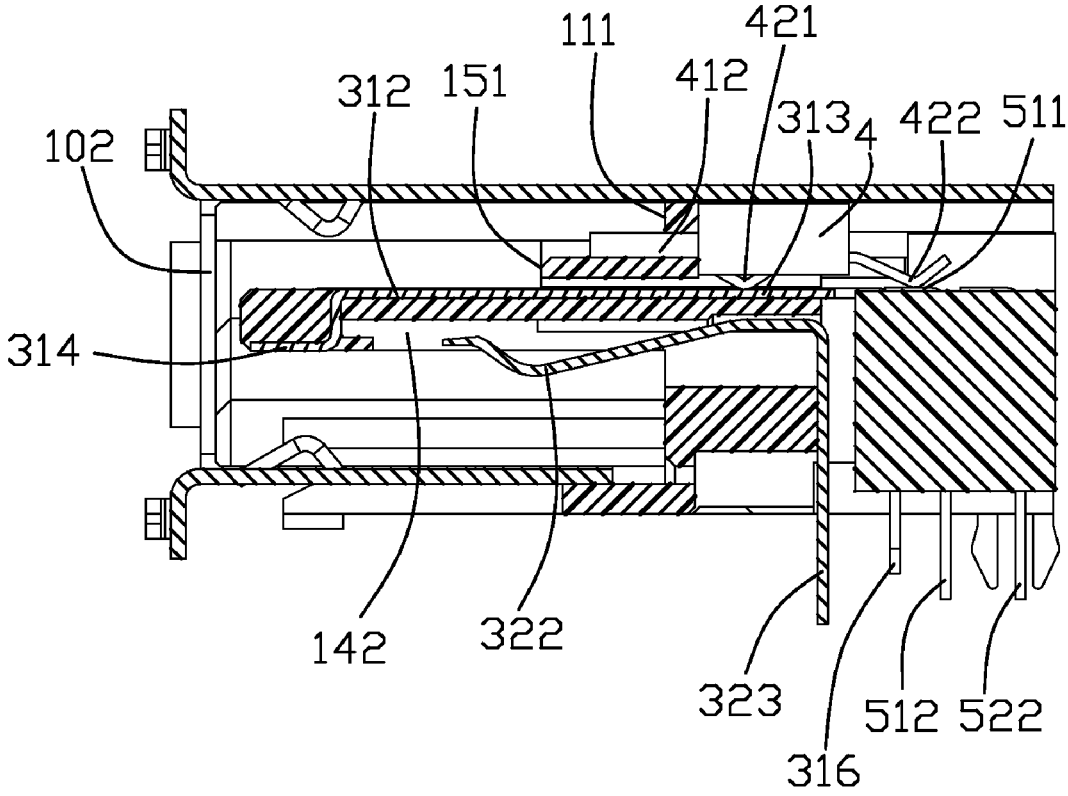
FIG. 7 is a cross-sectional view of the electrical connector shown in FIG. 1 along line 7-7.

As shown in FIGS. 4 and 7, the terminals 3 divide into a first set of terminals 31, totally seven eSATA terminals are included; and a second set of terminals 32, totally four USB terminals are included. The eSATA terminals 31 each includes a retention section 311 retained in the base portion 11, a blade contacting section 312 extending forwards from the retention section and a connecting section 313 horizontally and rearwards extending from the retention section. Two opposite outermost eSATA terminals 31 further perpendicularly extend downwardly to form solder sections 316. The contacting sections 312 of the eSATA terminals 31 are arranged in the passageways on the upper face of the tongue portion 14 to contact with the eSATA plug A. The contacting sections 312 are designated as eSATA contacting sections hereinafter. Five of said seven eSATA terminals 31, excluding said two outermost terminals, further define other contacting sections 314. Said contacting sections 314 are bent downward to the lower face of the tongue portion 14 and in front of the first contacting sections 312. The front contacting sections 314 connect with the first contacting sections 312 by jointing sections 315. The jointing sections 315 of the eSATA terminals 31 at the outer side of the row are bent laterally so that said five front contacting sections 314 are spaced from each other with enough intervals.

The USB terminals 32 each includes a retention section 321, a deflectable contacting section 322 forwards extending from the retention section into the mating cavity 101 and a solder section 323 bent downwards from the retention section. The contacting sections 322 are mating with USB 2.0 plug and are designated as USB 2.0 contacting sections. Said front contacting sections 314 together with the USB 2.0 contacting sections 322 are mating with USB 3.0 plug and are designated as USB 3.0 contacting sections. Said five eSATA terminals 31 located at middle thereof can be used for transmitting eSATA signals or USB 3.0 signals, which are designated as common terminals.

Referring to FIG. 3, the shuttle device in the first embodiment includes a shuttle member 4 and a switch member 5. The shuttle member 4 includes a board 41 made from insulating material and five switching terminals 42 embedded in the board 41. The switching terminals each includes a front touching section 421 projecting at a lower surface 411 of the board 41 and a rear deflectable touching section 422 extending out of the rear end of the board 41. A supporting portion 16 unitarily extends from a rear face of the base portion 11 and a pair of positioning slots 17 are respectively defined at opposite sides of the supporting portion 16. Combined with FIG. 6, the supporting portion 16 and the tongue portion 14 are located at a same level at their top surface. The connecting sections 313 of the eSATA terminals 31 run through the base portion 11 and are positioned at the upper surface of the supporting portion 16. The shuttle member 4 is located at the upper surface of the supporting portion 16 and defines a projected actuating portion 412 extending from a front end of a body portion 411 and being inserted into a through hole 112 on the base portion 11, and a pair of wing portions 413 at opposite sides of the body portion 411 sliding in the corresponding positioning slots 17.

Figure 5:
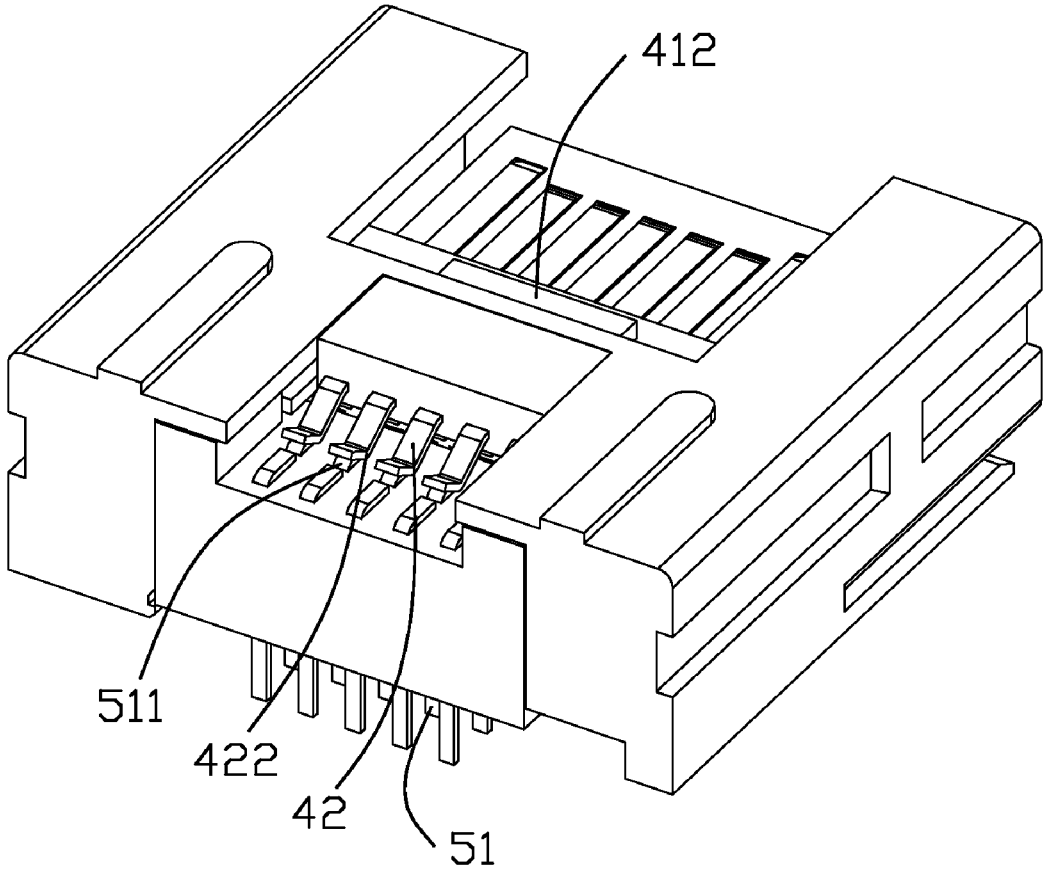
FIG. 5 is another perspective view of the electrical connector shown in FIG. 2 without the metallic shell thereon.
Figure 6:
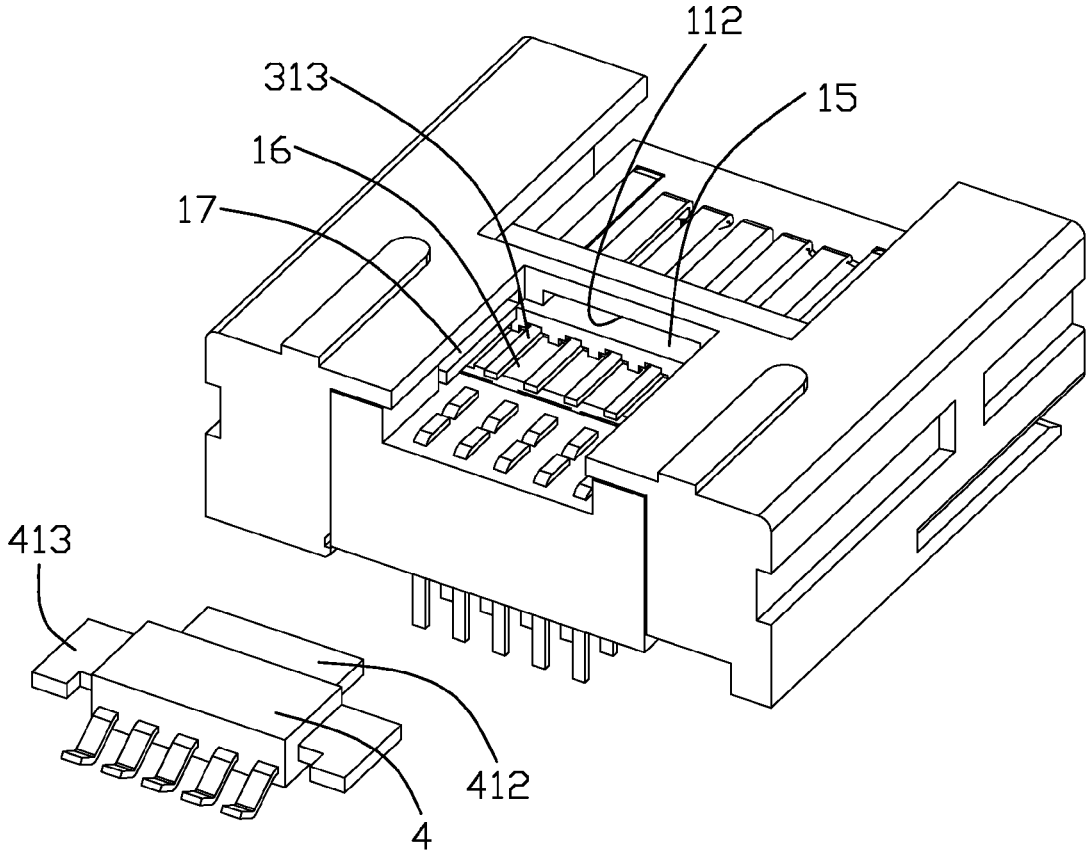
FIG. 6 is a partly assembled perspective view of the electrical connector shown in FIG. 4.

Referring to FIG. 3 and FIG. 4, the switching member 5 of this embodiment includes a positioning plate 6, a front row of first switching terminals 51 and a rear row of second switching terminals 52 which are insert-molded in the positioning plate 6. The rear row of the second switching terminals 52 are aligned with the front row in the front-to-rear direction. Each row of the second switching terminals 52 has five terminals in a same configuration but transmitting different signals, i.e. USB 3.0 signal. Each second switching terminal 51/52 includes a planar touching section 511/521 on the top face of the insulating base and a solder section 512/522 out of a bottom of the insulating base 50. The switching member 5 defines a pair of L-shaped retaining portion 61 on the top face thereof for interfering with a rear end 171 of the positioning slot 17 so as to be retained in the receiving cavity 103 of the insulating housing. Referring to FIG. 5 and FIG. 6, the switching member 5 is assembled in the receiving cavity 103 after the shuttle member 4 is assembled on the supporting portion 16 and the shuttle member 4 can slide along the positioning slot 17 on the top face of the switching member 5. Combined with FIG. 7, when there is no plug inserted into the mating cavity 101, the front touch sections 421 of the shuttle member 4 in contact with the connecting sections 313 of said five eSATA terminals 31 and the rear touch sections 422 of the shuttle member 4 is in contact with the front row of first switching terminals 51. At this condition, the USB 2.0 signal and the eSATA signal can be transmitted.

Referring to FIG. 4 and FIG. 7, the stand-off portion 15 is unitarily formed with the base portion 11 and the tongue portion 14 to increase the rigidity of the tongue portion 14. A front face 151 of the stand-off portion is closer to the front mating opening compared with the front face 111 of the base portion, both of which are used for distinguishing the insertion of different plugs A and B.

Figure 8:
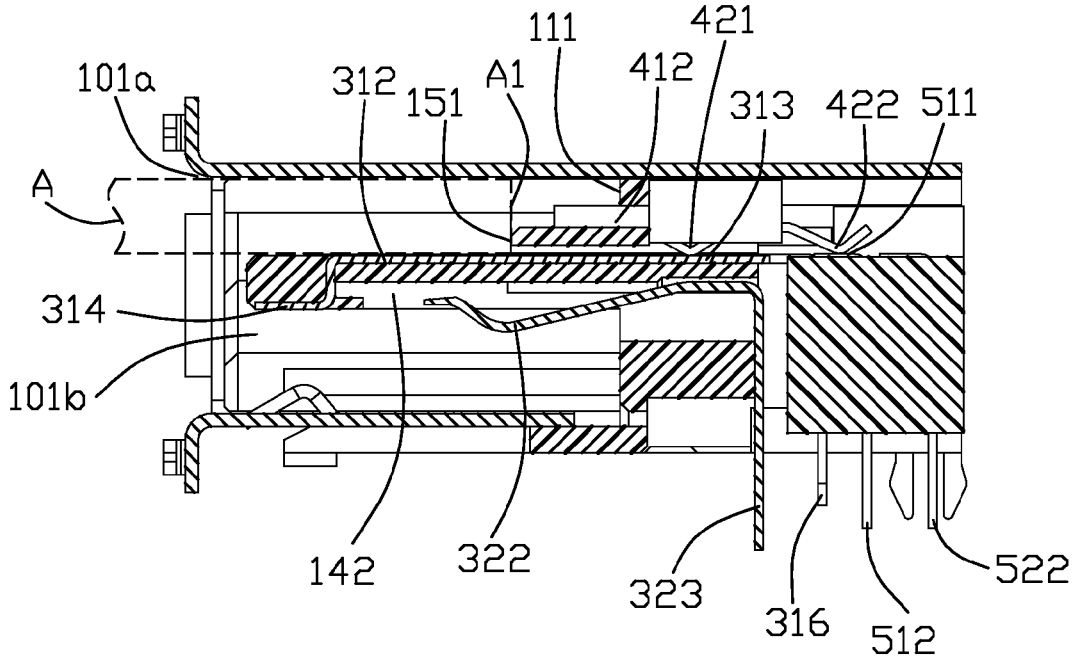
FIG. 8 is a same view of FIG. 7 with an eSATA plug inserted therein.
Figure 9:
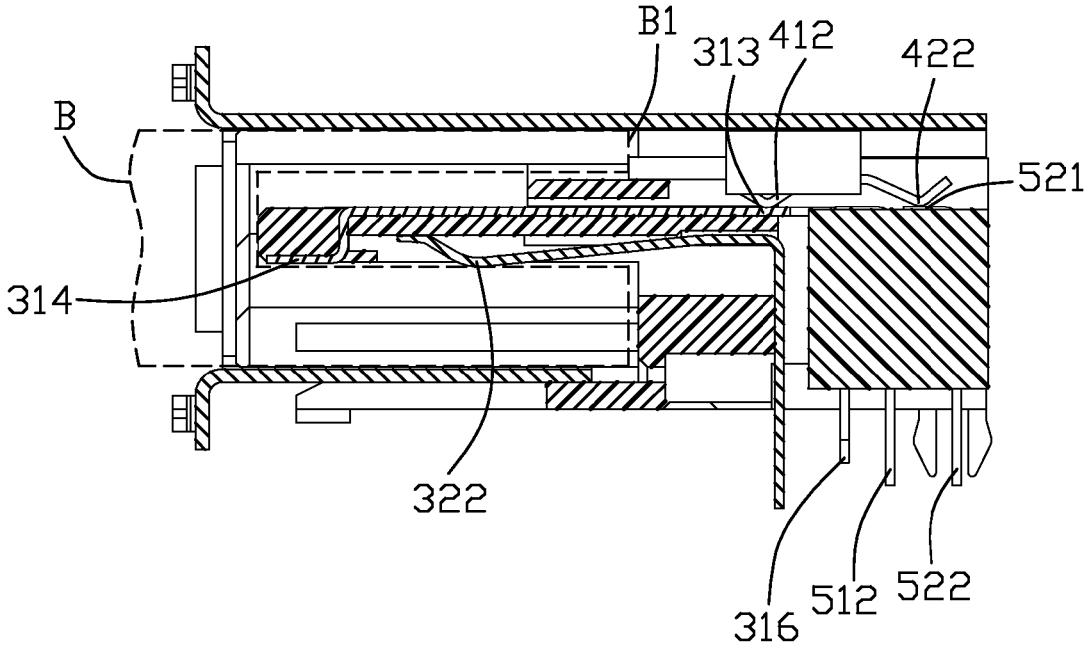
FIG. 9 is a same view of FIG. 7 with a USB 3.0 plug inserted therein.

FIG. 8 and FIG. 9 illustrate the illustrational view of the plugs inserted into the mating cavity 101. A USB 2.0 plug which is similar to a USB 3.0 plug can be inserted into a lower mating cavity 101*b* under the tongue portion 14 and in contact with the USB 2.0 contacting sections 322 so as to establish the signal transmission.

The eSATA plug A can be inserted into an upper mating cavity 101*a* until a front face of the mating port A1 abuts against the front face 151 of the stand-off portion 15 (i.e. the first stopping face 151), meanwhile, those seven terminals in the eSATA plug A electrically are in contact with the eSATA contacting sections 312. As the front face of the mating port A1 does not reach to the projected actuating portion 412, the shuttle member 4 is kept in an original position (i.e. the initial status), therefore the front touching sections 421 of the switching terminals 42 are in contact with the connecting sections 313 of those five eSATA terminals 31 and the rear touching sections 422 of the switching terminals 42 are in contact with the touching sections 511 of the first switching terminals 51 so as to establish the eSATA path for signal transmission.

The USB 3.0 plug can be inserted into a lower mating cavity 101*b* under the tongue portion 14 to electrically contact with the USB 3.0 contacting sections 322, 314. A front face of the mating port B1 moves forward until reaching to the front face 111 of the base portion 11 (i.e. the second stopping face 111). The projected actuating portion 412, exposed in front of the second stopping face 111, is pushed rearward and driving the shuttle member 4 to move backward. The front touching sections 421 of the shuttle member 4 move rearward while still kept in contacting with the connecting section 313. The rear touching sections 422 of the shuttle member 4 move toward the second switching terminals 52 to contact with the touching sections 522 so as to establish the USB 3.0 path for signal transmission. The electrical connector is mounted on a printed circuit board (PCB) and can output several different signals, when the electrical plug is inserted, the shuttle device switches the corresponding terminals so as to establish the corresponding path for signal transmission. As the shuttle device separates the signal output ends into several individual and dependent paths, when one plug is inserted and a corresponding path is established, the other paths are breaking off so as to ensure the signal transmission and avoid signal interference.

The shuttle member 4 of the shuttle device will be pushed inwardly when the USB 3.0 plug is inserted and also can return to its initial position by an ejecting device, for example a pair of coil springs, provided between the shuttle member and the insulative housing 1. The ejecting device can be incorporated with the insulative housing to provide a proper ejecting force, which is strong enough to push the shuttle device back to its original position, while will not alter the interconnection between the inserted plug and the receptacle connector. The structure and the working theory of the ejecting device, which are common knowledge to a person skilled in the art, are omitted here for simplification.

Figure 10:
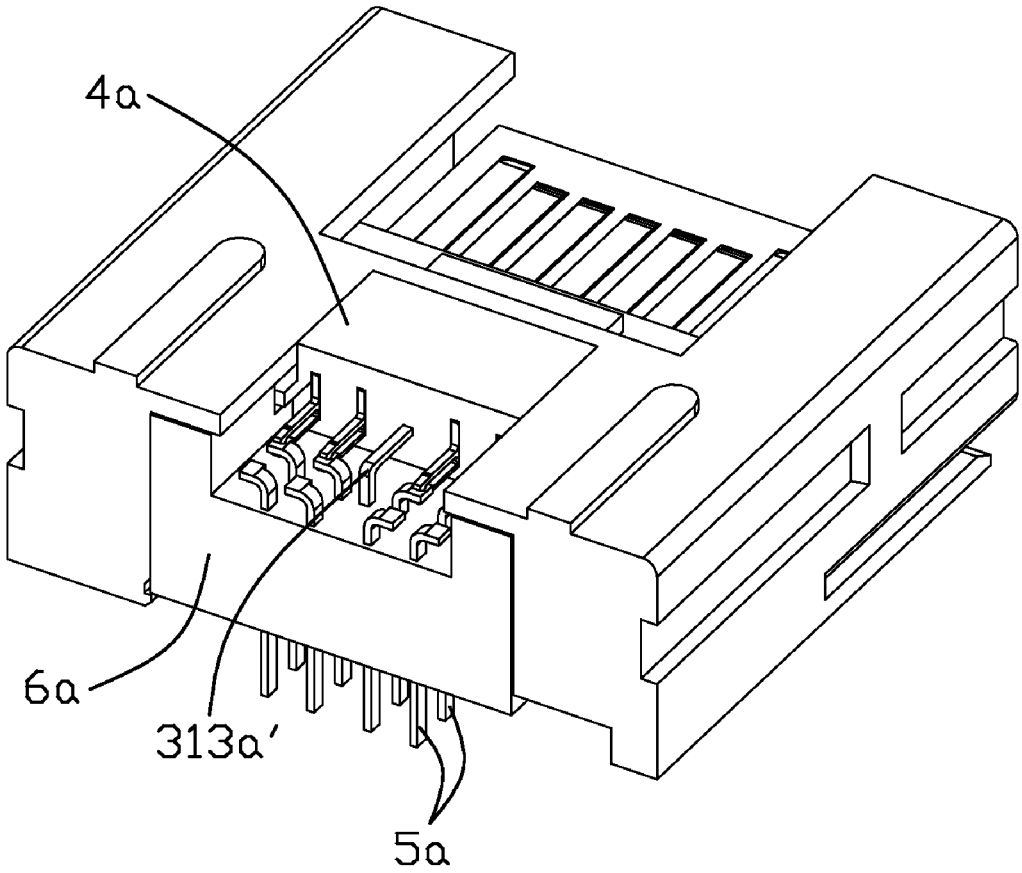
FIG. 10 is a perspective view of a second embodiment of the electrical connector without showing the metallic shell.
Figure 11:
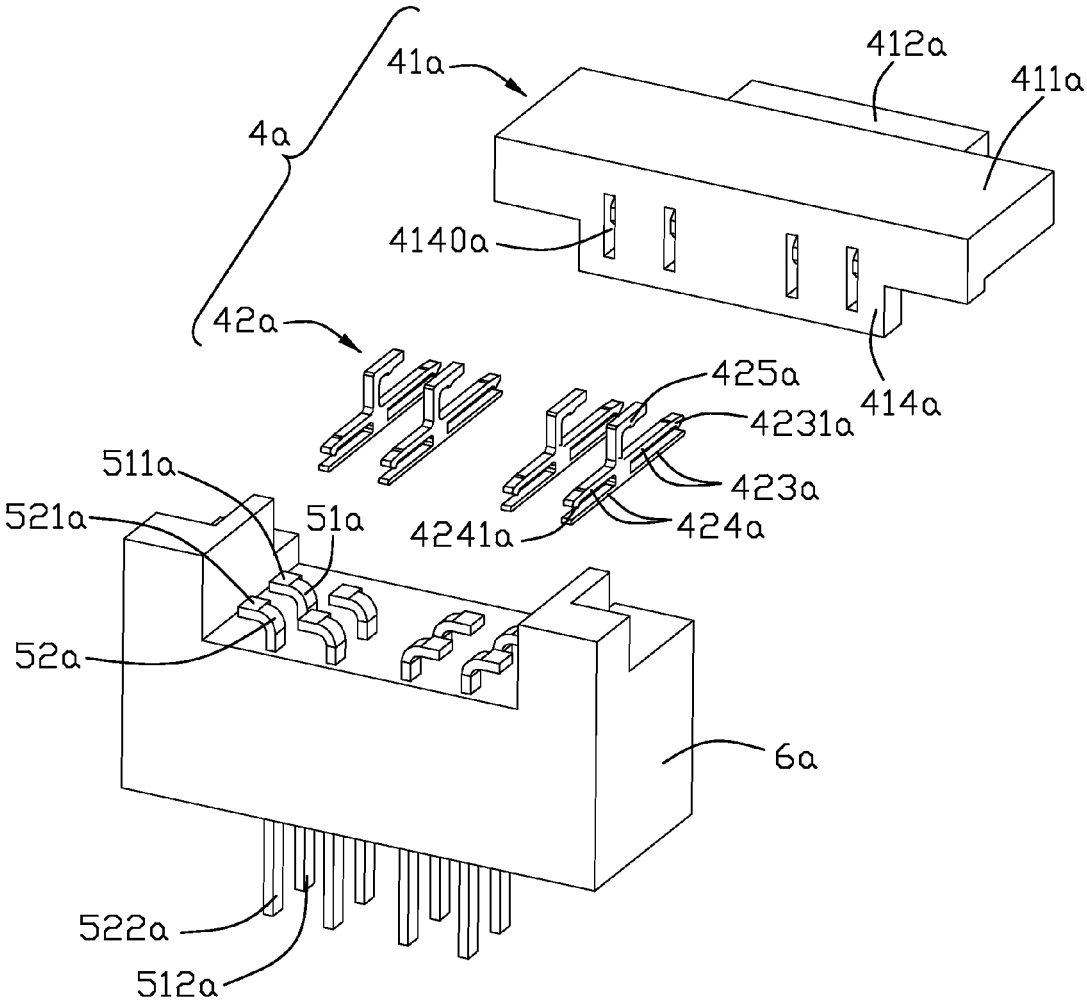
FIG. 11 is an exploded perspective view of the electrical connector shown in FIG. 10.
Figure 12:
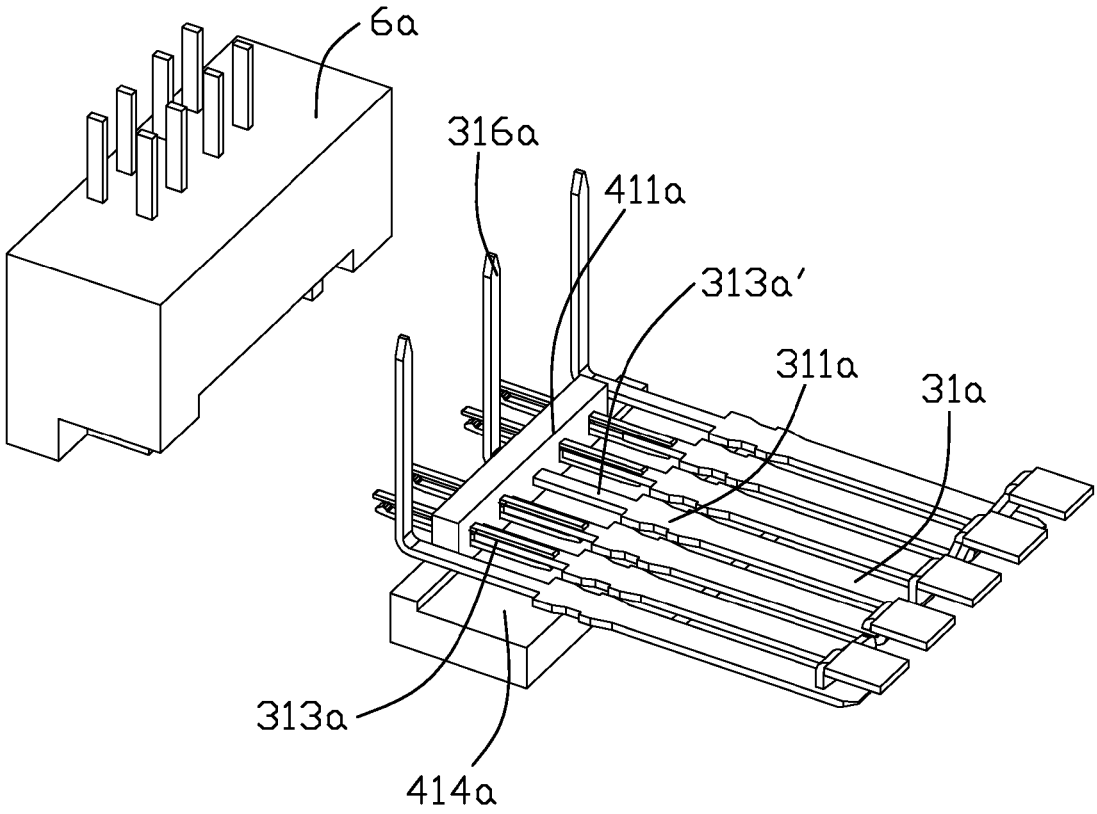
FIG. 12 is another exploded perspective view of the electrical connector shown in FIG. 10.

FIGS. 10-12 show a second embodiment of the electrical connector of the present invention, especially a second embodiment of the shuttle device. Four first switching terminals 51*a* and four second switching terminal 52*a* are respectively arranged in a front row and a rear row and secured in a positioning plate 6*a*. Each switching terminal 51*a*/52*a* comprises a solder portion 512*a*/522*a* and a touching section 511*a*/521*a* projecting out of the positioning plate 6*a* and bent laterally. The touching sections 511*a*/521*a* are offsetting with each other along a central line thereof.

The shuttle member 4*a* comprises a board 41*a* and four switching terminals 42*a*. The board 41*a* comprises a body portion 411*a* in a plate like configuration and a projected actuating portion 412*a* extending from a front end of the body portion 411*a*. A positioning board 414*a* extends downward from the body portion 411*a* and defines four passageways 4140*a* running therethrough for receiving said switching terminals 42*a*. Each switching terminal 42*a* comprises a pair of front latching arms 423*a*, a pair of rear latching arms 424*a* connecting with the front latching arms 423*a*, and a retention portion 425*a* connecting with a joint between the front and rear latching arms and spaced away from said latching arms. The upper front latching arm 423*a* forms a front latching portion 4231*a* protruding inwardly for contacting with the connecting section 313*a* when the connecting section 313*a* of the eSATA terminal 31*a* is sandwiched between the front latching arms 423*a*. Similarly, the upper rear latching arm 424*a* forms a rear latching portion 4241*a* protruding inwardly for contacting with the touching section 511*a* of the first switching terminal 51*a*. One of the five common terminals 31*a* which is in a middle position forms a solder portion 316*a* extending rearwards from the connecting section 313*a*' and bent downwardly for soldering onto the PCB, as said terminal is grounding terminal, it will not affect the signal transmission.

When the eSATA plug is inserted into the electrical connector, the shuttle member 4*a* will not be engaged and is located in the original position, the touching sections 511*a* of the first switching terminals 51*a* contact with the connecting sections 313*a* and establish the eSATA path for signal transmission. When the USB 3.0 plug is inserted into the electrical connector, the rear latching portion 4241*a* will disconnect from the first switching terminals 51*a* and interconnect with the second switching terminal 52*a*, therefore the USB 3.0 path for signal transmission is successfully established. So, the signal distribution is successfully accomplished.

Figure 13:
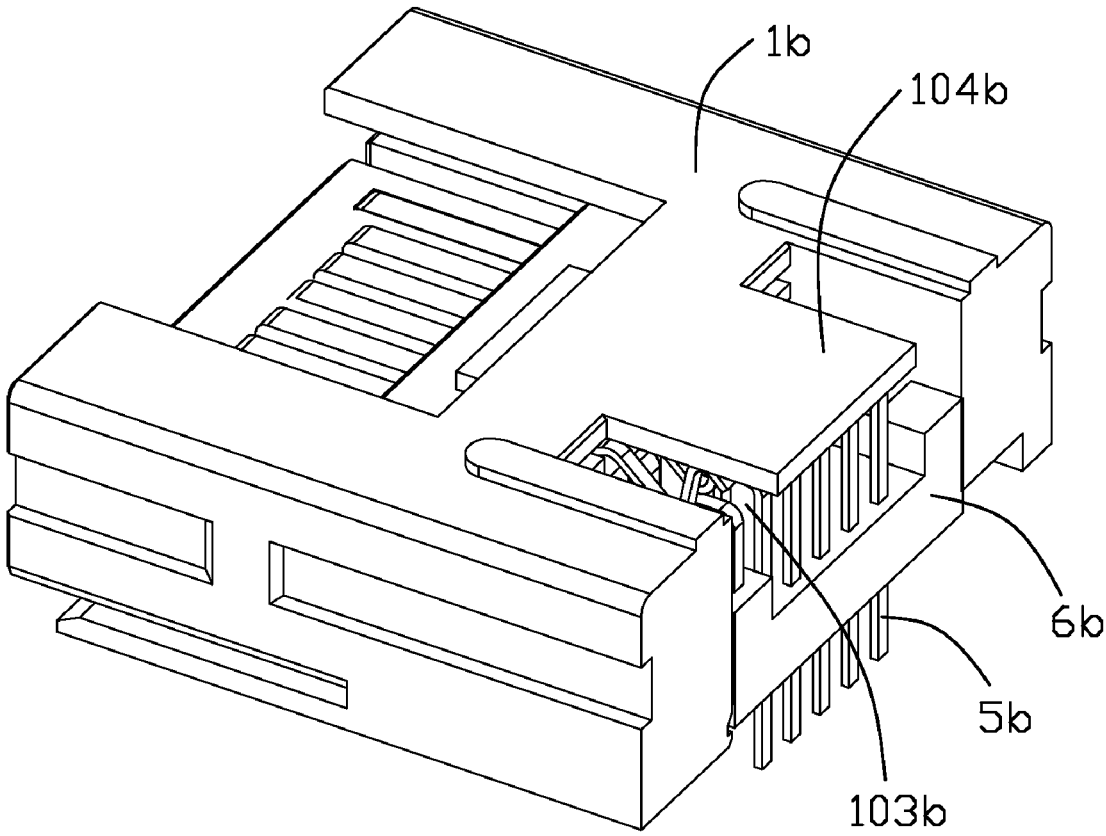
FIG. 13 is a perspective view of a third embodiment of the electrical connector without showing the metallic shell.
Figure 14:
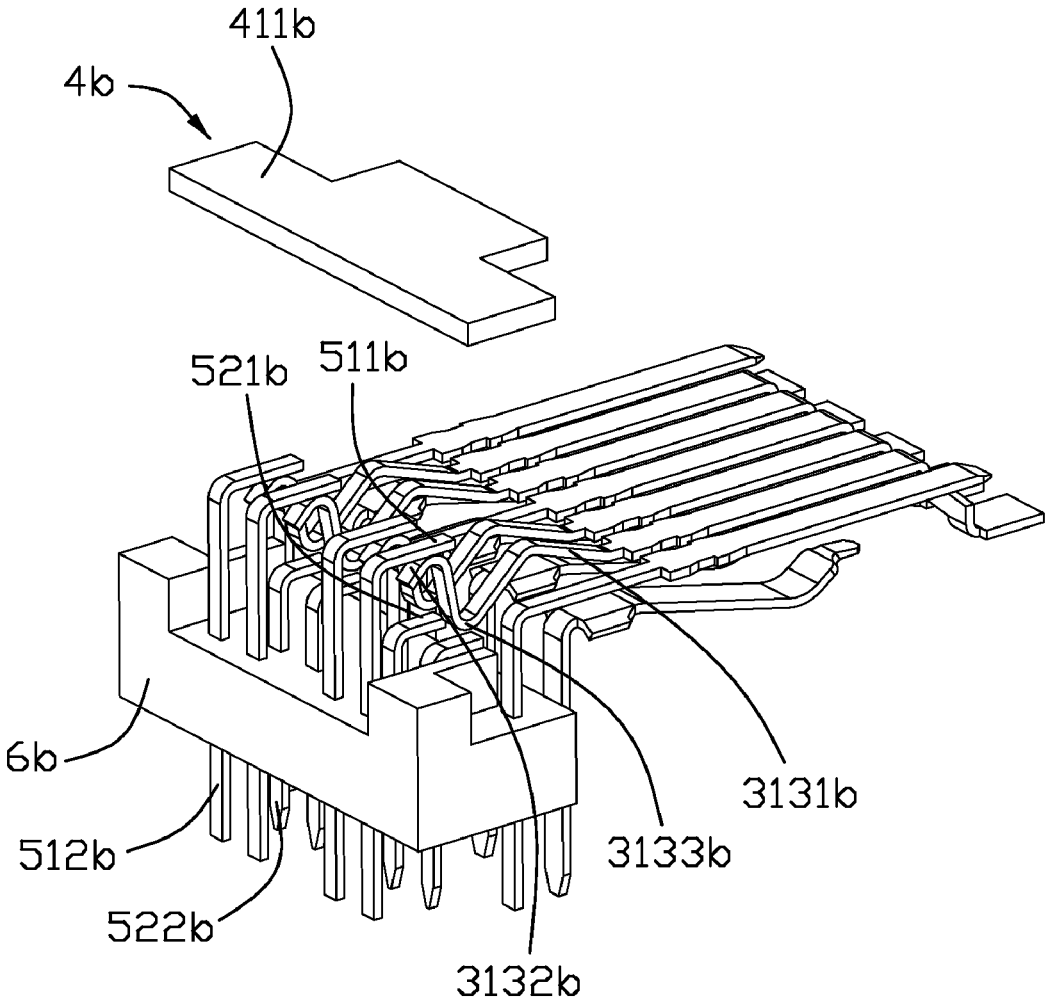
FIG. 14 is a perspective view of a part of the electrical connector shown in FIG. 13.
Figure 15:
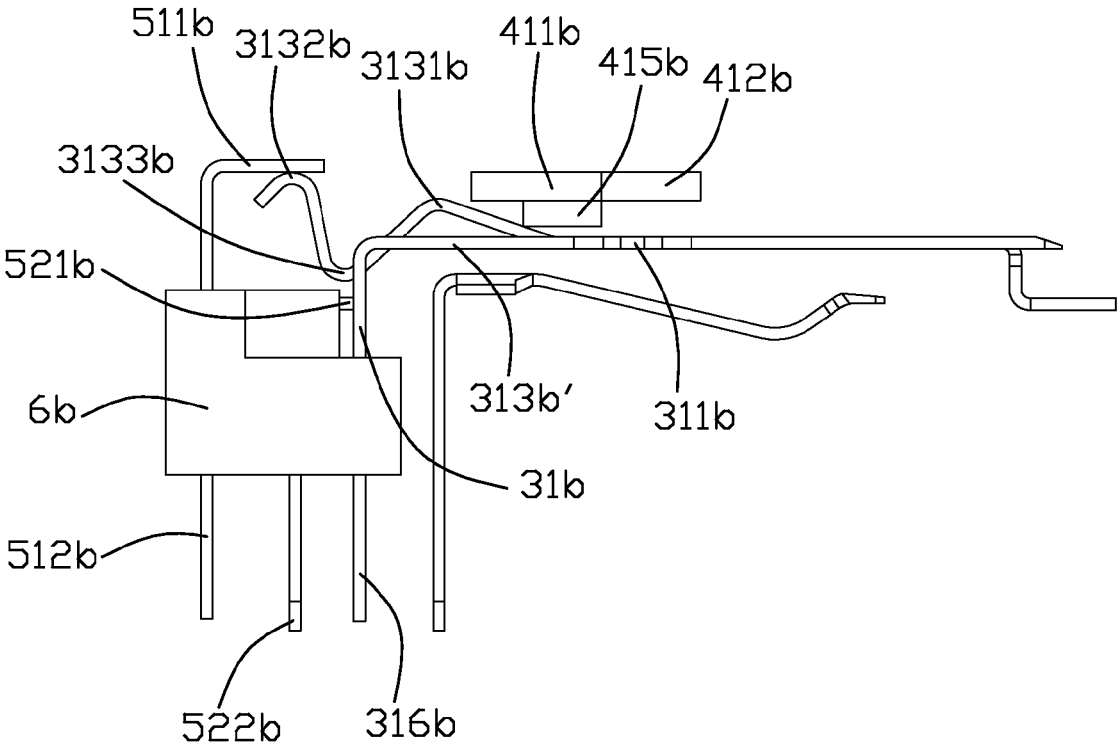
FIG. 15 is a side view of the part of the electrical connector shown in FIG. 14.

FIGS. 13-15 show a third embodiment of the electrical connector of the present invention, especially a third embodiment of the shuttle device. The positioning plate 6*b* is made thinner therefore the distance between the positioning plate 6*b* and the upper face of the insulative housing 1*b* becomes larger. Four first switching terminals 51*b* and four second switching terminals 52*b* are respectively arranged in a front row and a rear row and retained in the positioning plate 6*b*. Each switching terminal 51*b*/52*b* forms a solder portion 512*b*/522*b* extending out of the positioning plate 6*b* and a touching section 511*b*/521*b* projecting out of the positioning plate 6*b* and bent perpendicularly relative to the solder portion 512*b*/522*b*. The touching section 521*b* in the front row is lower than the touching section 511*b* in the rear row.

One of the five common terminals 31*b* which is in a middle position forms a solder portion 316*b* extending rearwards from the connecting section 313*b*' and bent downwardly for soldering onto the PCB, as said terminal is grounding terminal, it will not affect the signal transmission. Each of the other four of the five common terminals 31*b* defines a connecting section 313*b* exposed in the receiving cavity 103*b*. The connecting section 313*b* comprises a resilient pressing portion 3131*b* extending upward from the retention section 311*b*, a first resilient contacting portion 3133*b* bent downwards from the resilient pressing portion 3131*b*, and a second resilient contacting portion 3132*b* extending upwards and then downwards from the first resilient contacting portion 3132*b*. In the initial status, the second resilient contacting portion 3132*b* abuts against the touching section 511*b* of the first switching terminal 51*b* and the first resilient contacting portion 3133*b* locates right above the touching section 521*b* of the second switching terminal 52*b*. An extending plate 104*b* extends rearward from the base portion 11*b* for shielding the first and second resilient contacting portions 3133*b*, 3132*b* and the touching sections 511*b*, 521*b* within the insulative housing 1.

In this embodiment, there is no terminals retained in the shuttle member 4*b*, and the shuttle member 4*b* comprises a main body 411*b*, a pressing portion 415*b* extending forward from the main body 411*b*, and a projected actuating portion 412*b* extending from a front end of the main body 411*b*. When the USB 3.0 plug is inserted, the projected actuating portion 412*b* moves rearward and the pressing portion 415*b* presses against the resilient pressing portion 3131*b*, therefore the second resilient contacting portion 3132*b* will space away from the touching section 511*b* of the first switching terminal 51*b* and the first contacting portion 3133*b* in the lower side will contact with the touching section 521*b* of the second switching terminal 52*b*, therefore the USB 3.0 path for signal transmission is established.

Figure 16:
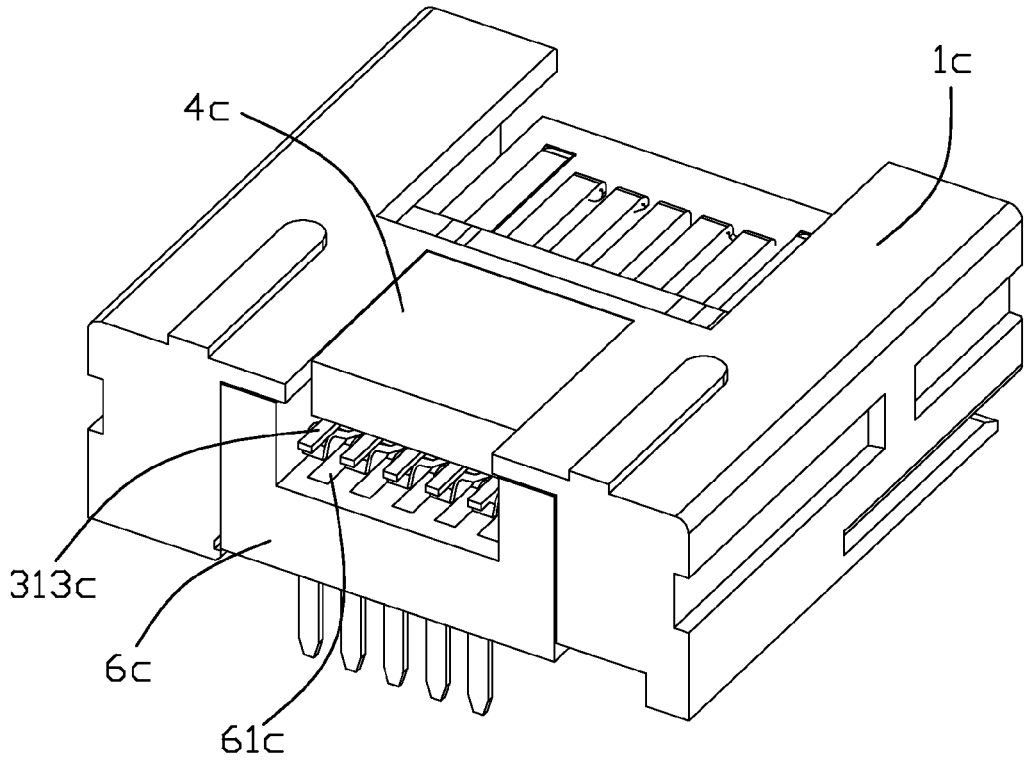
FIG. 16 is a perspective view of a fourth embodiment of the electrical connector without showing the metallic shell.
Figure 17:
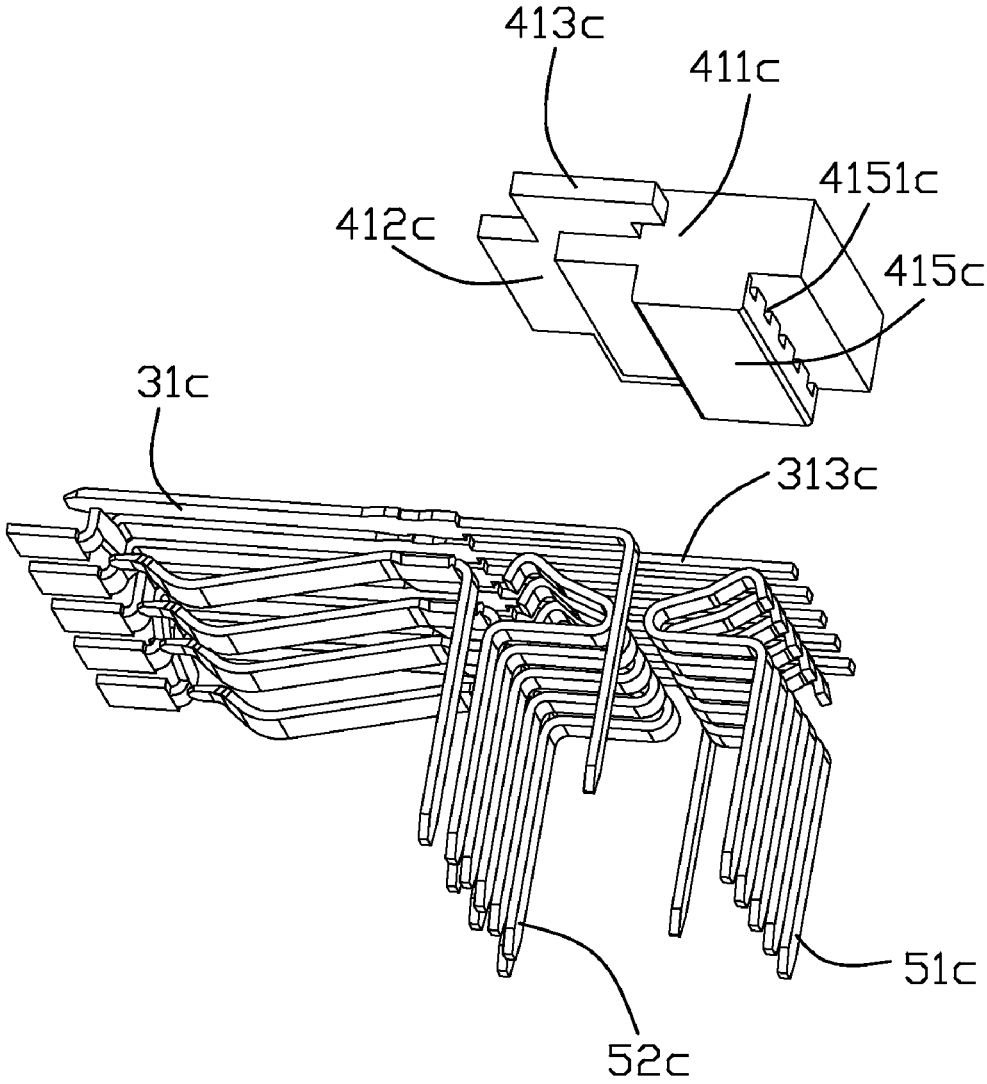
FIG. 17 is a perspective view of a part of the electrical connector shown in FIG. 16.
Figure 18:
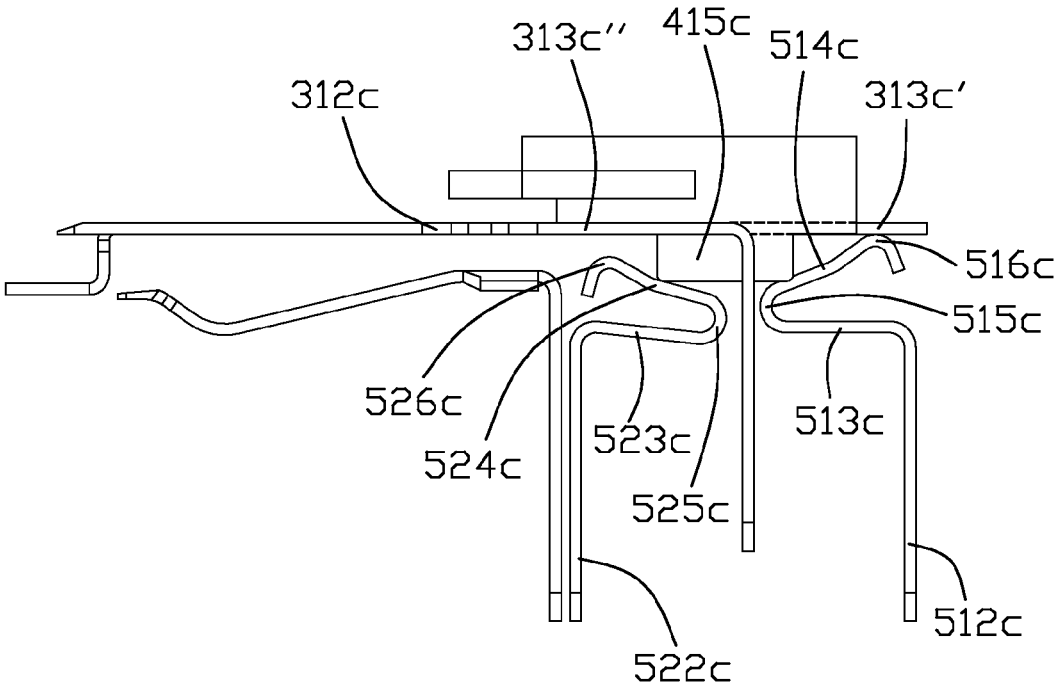
FIG. 18 is a side view of the part of the electrical connector shown in FIG. 17.

FIGS. 16-18 show a fourth embodiment of the electrical connector of the present invention, especially a fourth embodiment of the shuttle device. The first and second switching terminals 51*c*/52*c* are oppositely aligned with each other and are retained in the receiving passageways 61*c* defined in the positioning plate 6*c*. Each first and second switching terminals 51*c*/52*c* comprises a spring arm extending upward from the solder tail 512*c*/522*c*. The spring arm comprises a first bending arm 513*c*/523*c* bending from an upper end of the solder tail 512*c*/522*c*, a second bending arm 514*c*/524*c* bent reversely from end of the first bending arm 513*c*/523*c*, a connecting portion 515*c*/525*c* between the first and second bending arm, and an arch shaped contacting portion 516*c*/526*c*. As the first and second switching terminals

51*c*/52*c* are oppositely arranged, the distance between the connecting portions is shorter than that between the contacting portions.

In this embodiment, there is no terminals retained in the shuttle member 4*c*, and the shuttle member 4*c* comprises a main body 411*c*, a pressing portion 415*c* extending downwards from the main body 411*c*, and a pair of wing portions 413*c* at opposite lateral sides of the main body 411*c*. The pressing portion 415*c* defines a plurality of channels 4151*c* running therethrough along the front-to-rear direction. The connecting portions 313*c* of the five common terminals 31*c* are inserted into the channels 4151*c*, and each connecting portion 313*c* comprises a first connecting portion 313*c*' behind the pressing portion 415*c* and a second connecting portion 313*c*" before the pressing portion 415*c*. In the initial status, the pressing portion 415*c* is adjacent to the mating opening with its bottom face slightly abutting against the second bending arm 514*c*, and the contacting portion 516*c* contacts with the first connecting portion 313*c*'. While the bottom face of the pressing portion 415*c* abuts against the second bending arm 524*c* heavily, therefore the corresponding contacting portion 526*c* spaces away from the second contacting portion 313*c*".

When the USB 3.0 plug is inserted into the electrical connector, the projected actuating portion 412*c* is pushed to move rearward together with the pressing portion 415*c*. During the process, the pressing portion 415*c* will no longer press against the second bending arm 514*c* and increase the pressing force against the second bending arm 524*c*, therefore the contacting portion 516*c* of the first switching terminal 51*c* will space away from the first contacting portion 313*c*', and the contacting portion 526*c* of the second switching terminal 52*c* will recover its elasticity and in contact with the second contacting portion 313*c*". The signal distribution is accomplished in this embodiment in such a manner.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector, including at least three mating interfaces, comprising an insulative housing;

a first group of contacts serving as first Interface (USB 2.0);

a second group of contacts alternatively serving as mating interface of second and third interfaces (ESATA and USB 3.0);

a switching board including mounting interface of the second and the third interfaces; and a shuttle member moveably disposed within the housing and selectively interconnecting the second group of contacts with either the mounting interface of the second interface or mounting interface of the third interface.

2. The receptacle connector as described in claim 1, wherein the second group of contacts comprise first contacting sections forming the second interface and second contacting sections exposed to the first interface to cooperate with the first group of contacts to form the third interface.

3. The receptacle connector as described in claim 2, wherein the insulative housing defines a mating tongue forward extending, the first contacting sections are located at an upper face of the mating tongue while the second contacting sections together with the first group of contacts are located at a lower face of the mating tongue.

4. The receptacle connector as described in claim 1, wherein the switching board includes a plurality of first switching terminals and a plurality of second switching terminals alternatively to electrically contact with at least one contact of the first group.

5. The receptacle connector as described in claim 4, wherein the first and second switching terminals are retained in a positioning board and define corresponding touching sections located at different levels, said at least one contact comprises a first contacting point and a second contacting point located at different levels, the rearward movement of the shuttle member urges the first contacting points spaced away from the touching sections of the first switching terminals, meanwhile the second contacting points move toward and electrically contact with the touching sections of the second switching terminals.

6. The receptacle connector as described in claim 5, wherein a resilient pressing portion is formed in front of the first and second contacting points and located under the shuttle member.

7. The receptacle connector as described in claim 4, wherein the at least one contact is located right above the first and second switching terminals, the shuttle member is located between the first and second switching terminals only allowing the first switching terminals to electrically contact with the at least one contact or the second switching terminals to electrically contact with the at least one contact.

8. The receptacle connector as described in claim 7, wherein the first switching terminal comprises a first contacting portion in an arc configuration and connected by a first resilient arm, the second switching terminal comprises a second contacting portion in an arc configuration and connected by a second resilient arm, the shuttle member comprises a pressing portion located between and above the first and second resilient arms, therefore if the first resilient arm is pressed downward by the pressing portion, the first contacting portion will disconnect with at least one contact, meanwhile the second contacting portion move to electrically contact with the at least one contact.

9. The receptacle connector as described in claim 4, further comprising additional terminals retained in the shuttle member and each defines a first link portion kept in contacting with the at least one contact no matter the shuttle member is moved or not, and a second link portion alternatively to electrically contact with the first or the second switching terminals according to the movement of the shuttle member.

10. The receptacle connector as described in claim 2, wherein the shuttle member defines a projected portion exposed at a rear end of the second interface.

11. An electrical connector adapted for being inserted into a first plug or a second plug different from the first plug, the electrical connector comprising:

an insulating housing defining a mating cavity with an opening in a front end for receiving said first plug or the second plug therein;

a plurality terminals exposed in said mating cavity and comprising at least one first terminal to not only electrically contact with the first plug when the first plug is inserted but also electrically contact with the second plug when the second plug is inserted;

a first stopping face defined in said mating cavity for stopping the insertion of the first plug and a second stopping face defined in said mating cavity behind the first stopping face for stopping the insertion of the second plug; and a shuttle device comprising a shuttle member forming a projecting portion located between the first and second stopping faces to judge which plug is inserted into the receiving cavity and to establish the corresponding signal transmission path.

12. The electrical connector as described in claim 11, wherein said at least one first terminal comprises a connecting portion extending rearward but does not have a solder tail.

13. The electrical connector as described in claim 11, wherein said at least one first terminal comprises two contacting portions located at different levels in a vertical direction.

14. The electrical connector as described in claim 12, wherein a plurality of first switching terminals and second switching terminals each having a solder tail are provided, the connecting portion of the at least one first terminal alternatively and electrically contacts with the first switching terminal or second switching terminal by the movement of the shuttle member.

15. An electrical connector for mounting to a printed circuit board and mating to one of first and second complementary connectors, comprising:

an insulative housing defining a receiving cavity with a mating tongue extending therein and defining opposite first and second surfaces thereof;

a first set of contacts each having first and second contacting sections respectively exposed upon the first surface and the second surface;

a second set of contacts and a third set of contacts located behind said first set of contacts, each of said second set of contacts and said third set of contact defining a tail for mounting to said printed circuit board; and a shuttle associated within the housing and moveable between first and second positions in a front-to-back direction; wherein when the shuttle is located in the first position during mating with the first complementary connector, the first set of contacts are electrically connected to the second set of contacts and transmitting signals to the printed circuit board via said second set of contacts; when the shuttle is located in the second position during mating with the second complementary connector, the first set of contacts are electrically connected to the third set of contacts and transmitting signals to the printed circuit board via said third set of contacts.

16. The electrical connector as claimed in claim 15, wherein the shuttle is equipped with corresponding terminals to constantly mechanically connect to the first set of corresponding contacts and selectively to one set of the second set and the third set of contacts according to either the first position or the second position.

17. The electrical connector as claimed in claim 15, wherein shuttle is not equipped without any corresponding terminals to constantly connect to the corresponding first set of contacts and selectively to one set of the second set and the third set of contacts, but actuating rear sections of the first set of contacts to selectively contact one set of the second set and the third set of contacts according to either the first position and the second position.

18. The electrical connector as claimed in claim 17, wherein said rear sections of the first set of contacts provide urging forces to push the shuttle back from the second position to the first position.

* * * * *